United States Patent [19]

Porucznik et al.

[11] Patent Number: 4,854,149

[45] Date of Patent: Aug. 8, 1989

[54] REDUCING THE DIAMETER OF TUBULAR BODIES

[75] Inventors: Paul Porucznik, Oxford; Christopher F. Cheers, Swindon, both of England

[73] Assignee: Metal Box plc, Reading, England

[21] Appl. No.: 213,056

[22] Filed: Jun. 29, 1988

[30] Foreign Application Priority Data

Jun. 30, 1987 [GB] United Kingdom ..... 8715270

[51] Int. Cl.[4] ..... B21D 41/04

[52] U.S. Cl. ..... 72/352; 72/370; 72/710; 413/69

[58] Field of Search ..... 413/69; 72/285, 352, 72/354, 370, 710

[56] References Cited

U.S. PATENT DOCUMENTS

| | | | |
|---|---|---|---|
| 3,209,574 | 10/1965 | Boyd | 72/285 |
| 3,274,812 | 9/1966 | Evans | 72/285 |
| 4,261,193 | 4/1981 | Boik | 72/370 |

FOREIGN PATENT DOCUMENTS

| | | | |
|---|---|---|---|
| 105838 | 8/1981 | Japan | 72/370 |

*Primary Examiner*—Lowell A. Larson

*Attorney, Agent, or Firm*—Diller, Ramik & Wight

[57] ABSTRACT

A method and apparatus for reducing the cross-section of a terminal portion of a tubular body said apparatus comprising an external die which defines a convergent work surface therein of like shape to the exterior of the reduced cross-section to be produced; a plug having a work surface thereon of like shape to the interior of the reduced cross-section to be produced; means to hold the plug in axial alignment with the die during relative motion as between the plug and die to center the plug within the die to define a pass gap of shape and gap width substantially equal to that shape and thickness of the reduced cross-section; means to enter the terminal portion of the tubular body into the pass gap between the plug and die; and means to cause the die to vibrate in a radial mode at an ultrasonic frequency while the terminal portion is progressively reduced to the shape of the pass gap.

16 Claims, 15 Drawing Sheets

FIG.5(1)
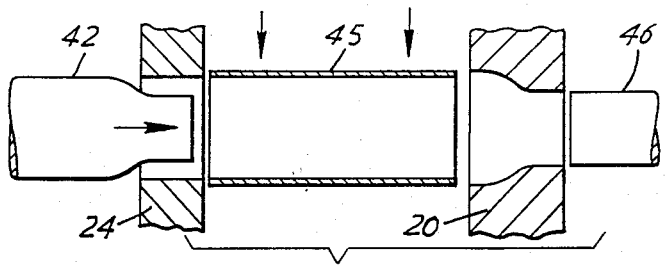
FIG.5(2)
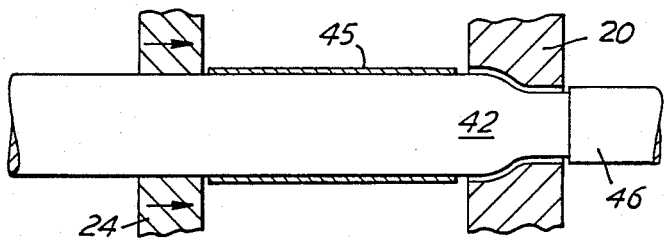
FIG.5(3)
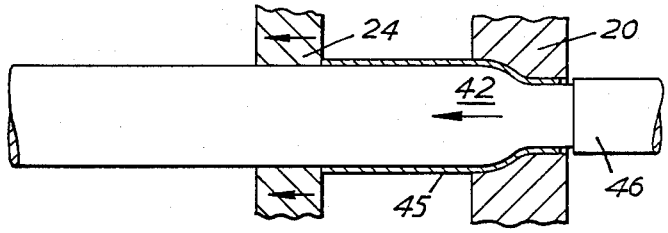
FIG.5(4)
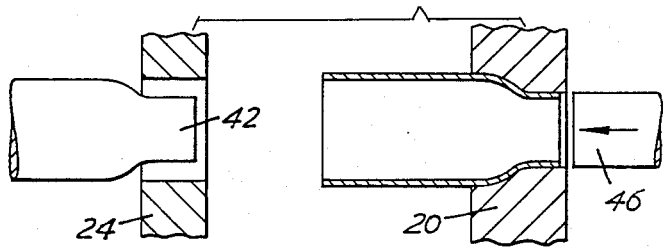
FIG.5(5)
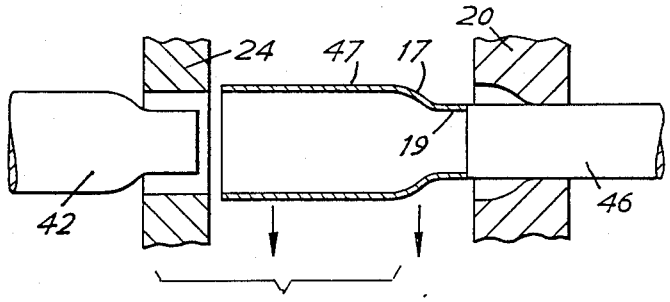
FIG.5(6)

FIG. 7a (1)
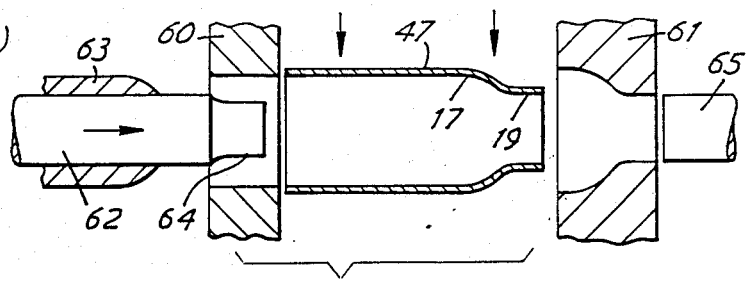
FIG. 7a(2)
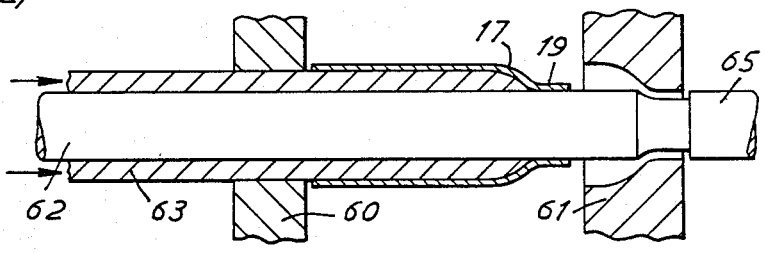
FIG. 7a(3)
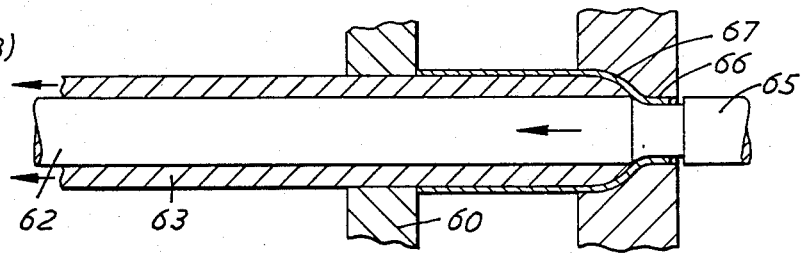
FIG. 7a(4)
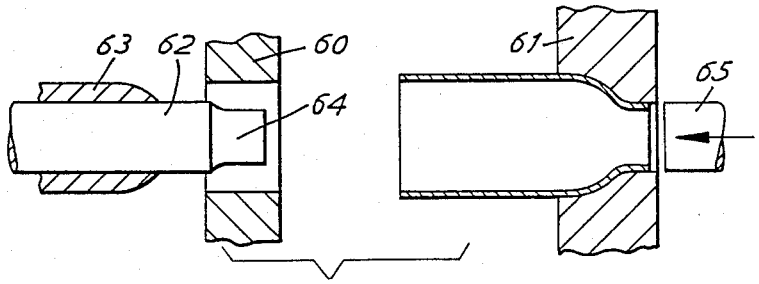
FIG. 7a(5)
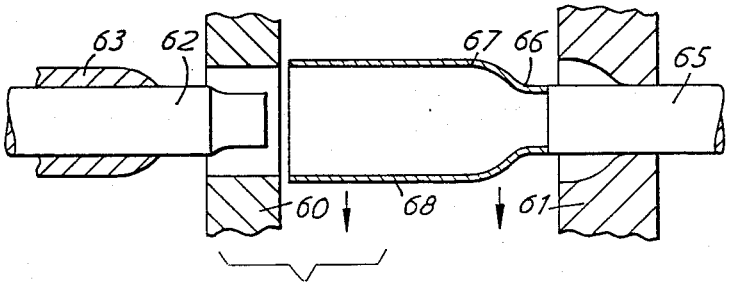
FIG. 7a(6)

REDUCING THE DIAMETER OF TUBULAR BODIES

BACKGROUND OF THE INVENTION

1. Field of the Invention

This invention relates to a method and apparatus for reducing the mouth of a tubular body and more particularly but not exclusively to the formation of a shoulder and neck on a container body.

Cans for soft drinks are provided with a shoulder neck and flange of diameter less than that of the rest of the can body in order to reduce the diameter of the mouth so that a smaller, and therefore cheaper, aluminium or steel tear-open can end may be used. Aerosol containers are also known which have a shoulder portion terminating in an aperture to receive the standardised 1 inch diameter valve cup.

2. Description of Related Art

In known die necking operations, such as are described in U.S. Pat. No. 1,698,999 (Hothersall) or U.S. Pat. No. 4,527,412 (Stoffel et al), each die is only able to form a limited amount of reduction in the diameter of the tubular body presented to it. Typical reductions in diameter at each die are discussed in U.S. Pat. No. 3,995,572 (Saunders) as being about 3.1 mm (0.122 inch) on a steel body 38.1 mm (1.5 inch) dia. at a first die and lesser reductions at subsequent dies. Whilst greater reductions can be achieved by a combination of a die necking process followed by a roll forming operation as is discussed in British Pat. No. 2,083,382 (Metal Box) the necessity for both die necking and roll forming apparatus incurs considerable capital expense.

In the tube drawing art several authors have proposed the use of ultrasonic vibration of the plug or die to assist the reduction process. In U.S. Pat. No. 3,212,312 (Boyd), apparatus is described in which both plug and die are vibrated in a direction along the axis of the tube as the tube is drawn between the plug and die to be reduced in diameter. Boyd's claims relate to a drawbench in which a selected phase relationship is deliberately established between the vibration at the plug and at the die. British Pat. No. 1,379,234 (Dawson & Sansome) also describes a draw bench in which both plug and die are vibrated axially and concludes that optimum performance is achieved in certain cases when the phase angle between the plug and die vibrations is neither 0° nor 180° but is somewhere between the two, the value depending on several factors.

British Pat. No. 1,389,214 (Sansome et al) describes apparatus for drawing a circular metal blank into a cup. The apparatus comprises a die, a punch and a blank holder. The die and blank holder are connected to an array of transducers which induce radial vibrations in the die and blank holder to assist drawing of the blank as the punch enters the die.

This prior art of draw benches illustrates that benefit of reduced friction at the interface between the workpiece and die can be achieved by ultrasonic vibration of the die but does not teach tool arrangements suitable for localised deformation of one end portion of a tubular body such as a can body. In an article in SOVIET ENGINEERING RESEARCH Vol. 3 No. 12 pages 54.55 titled "Upsetting of Aerosol containers using Ultrasound", apparatus is depicted and described in which a cylindrical container body 45 mm diameter is reduced by a sequence of several dies to 26.5 mm diameter to define a shoulder and neck to which an aerosol valve cup may be crimped. The apparatus comprises a short cylindrical plug entered into a die which has three transducers equispaced around it to induce radial vibrations in the die. We have found that the cylindrical plug is not ideal because the tubular body is not supported internally during the early part of the deformation process.

SUMMARY

Accordingly in a first aspect this invention provides a method of reducing the cross-section of a terminal portion of a tubular body, said method comprising the steps of providing an external die which defines a work surface therein of like shape to the exterior of the reduced cross-section to be produced; providing a plug having a work surface thereon of like shape to the interior of the reduced cross-section to be produced; locating the plug within the die to define therebetween a pass gap having the shape of the reduced cross-section to be produced and a radial width substantially equal to the thickness of the tubular body; entering the terminal portion of the tubular body into the pass gap; and simultaneously causing the die to vibrate in a radial mode at an ultrasonic frequency while the terminal portion is progressively deformed to the shape of the pass gap.

In a second aspect this invention provides apparatus for reducing the cross-section of a terminal portion of a tubular body said apparatus comprising an external die which defines a convergent work surface therein of like shape to the exterior of the reduced cross-section to be produced; a plug having a work surface thereon of like shape to the interior of the reduced cross-section to be produced; means to hold the plug in axial alignment with the die during relative motion as between the plug and die to centre the plug within the die to define a pass gap of shape and gap width substantially equal to that shape and thickness of the reduced cross-section; means enter the terminal portion of the tubular body into the pass gap between the plug and die and means to cause the die to vibrate in a radial mode at an ultrasonic frequency while the terminal portion is progressively reduced to the shape of the pass gap.

BRIEF DESCRIPTION OF THE DRAWINGS

FIG. 5 shows diagrammatically the apparatus of FIG. 4 at various stages in the formation of the shoulder and neck;

FIG. 7*a* shows diagrammatically an optional second necking operation;

DESCRIPTION OF THE PREFERRED EMBODIMENTS

Figures 1A, 1B, 1C, 1D:
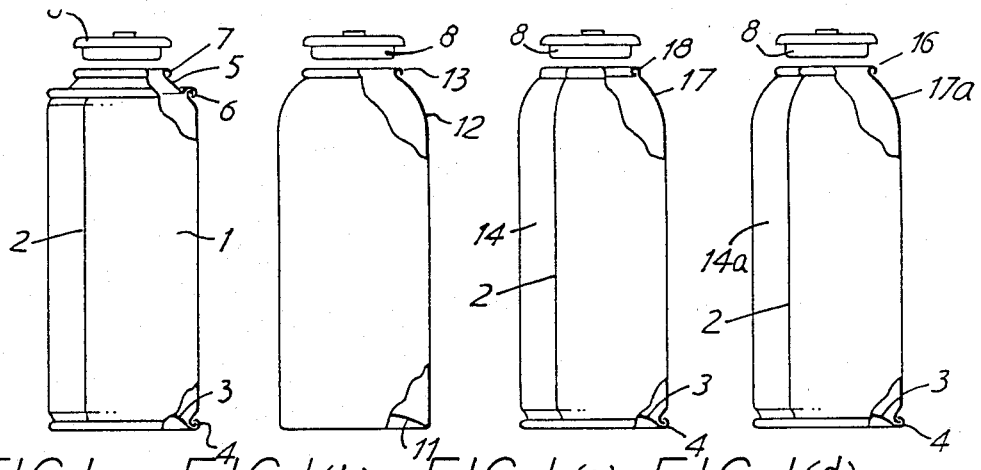
FIG. 1*a* is part sectioned side view of a known aerosol can and valve cup.
FIG. 1*b* is a like view of a known extruded aluminium aerosol can having a shoulder and neck of reduced diameter.
FIG. 1*c* is a like view of a welded aerosol can having body reduced in diameter at a shoulder and neck supporting an inwardly directed curl.
FIG. 1*d* is a like view of a welded can having an outwardly directed curl.

In FIG. 1*a* a known tinplate aerosol can comprises a tubular body 1 having a soldered or welded side seam 2. A domed bottom end 3 is attached to one end of the tubular body 1 by means of a double seam 4. A "cone top" 5 is attached to the other end of the tubular body by means of a double seam 6. The "cone top" 5 comprises the peripheral seam material, a chuck wall entering the body, a shoulder or "cone" portion rising through the chuck wall inwardly and axially to terminate as an outwardly directed curl 7. The curl 7 is profiled to receive the standard 1 inch diameter valve cup 8 depicted above the can.

In FIG. 1*b* the known aluminium aerosol can 9 is extruded from a slug or circular disc of aluminium to a cylindrical tube 10 closed at one end by the bottom wall 11. The open end is reduced by a plurality of external reducing dies to an ogee shaped shoulder 12 which supports a short cylindrical neck. The neck is turned outwards by a die to create the outwardly directed curl 13 of FIG. 1*b* in readiness for fitting of the valve cup 8 depicted above it.

FIG. 1*c* shows an aerosol can having a tubular body 14 formed from a rectangular blank of tinplate by folding the blank to a tube and joining the contiguous edges by means of a weld 2.

As depicted, a lower end of the tubular body has been necked in and flanged to receive a domed bottom end 3 fixed to the necked in lower end of the tubular body by a double seam 4 which is flush with the body. The top end of the tinplate tubular body has been necked in to a shoulder 17 by the method about to be described and an internal curl 18 formed to define an orifice to receive the standard valve cup 8 depicted above. When the can of FIG. 1*c* stands upon a surface it resembles the more costly aluminium can of FIG. 1*b* because the double seam is not obtrusive. Typically the tinplate body is about 45 mm diameter and the orifice defined by the curl is about 25 mm diameter to receive the plug portion of the valve cup.

The formation of the shoulder 17 and a neck of reduced diameter (e.g. 31 mm) in one ultrasonically assisted die necking operation, in contrast to the several operations used in the prior art, will be described. The 31 mm diameter neck is then formed radially inwards by a curling die to form an inwardly directed curl 18 defining a mouth to receive the 25.4 mm (1 inch) aerosol cup 8 down above.

FIG. 1*d* shows a welded aerosol can body 14*a* similar to that shown in FIG. 1*a* so like parts are denoted by the same part numbers i.e. bottom 3, bottom seam 4, side seam or weld 2. However, the curl 16 is outwardly directed so that the cut edge is outside the can and well away from any corrosive product to be packed in the can. Notice that the shoulder profile 17*a* extends further into the can to support the inner "neck" or mouth defining surface of the curl. This means the tubular wall has to be deformed from 45 mm diameter down to 25.4 mm diameter (1 inch) and reformed outwardly to the curl shape. The reduction from 45 mm to a neck of 31 mm, conveniently done in one ultrasonically assisted die, may then be followed by a second reduction of the 31 mm neck to an extended shoulder portion and neck of 25.4 mm (1 inch) diameter as will be described later with reference to FIG. 7*a*.

Figure 2:
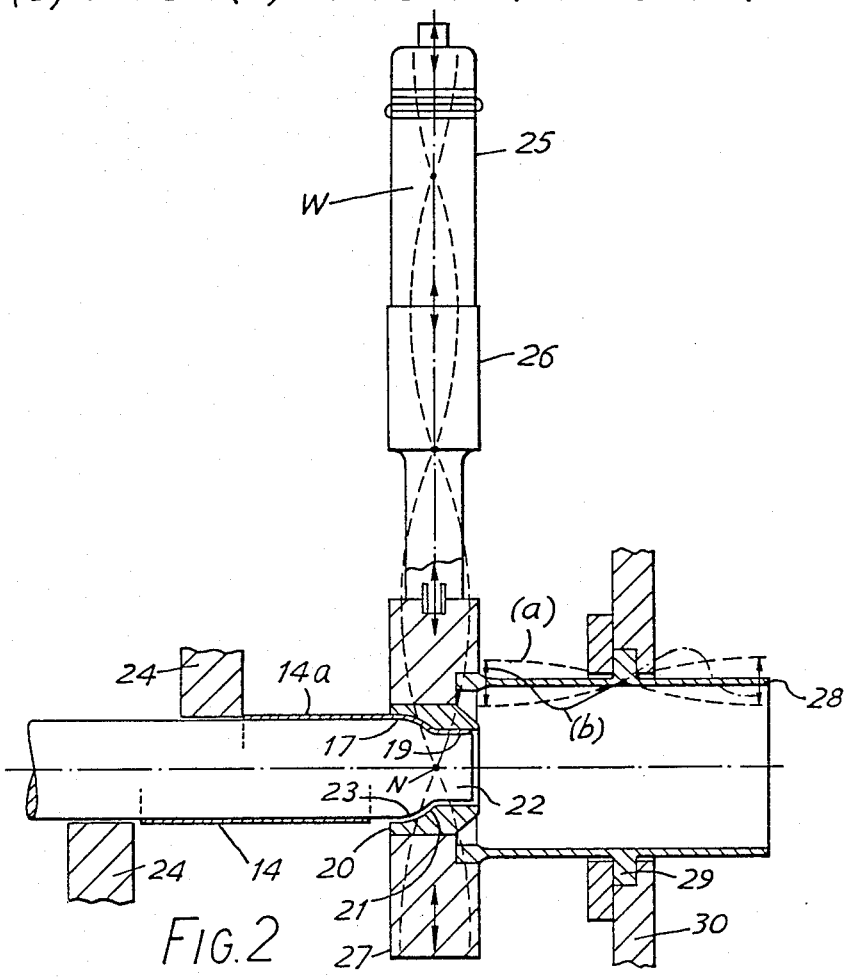
FIG. 2 is a diagrammatic side view of apparatus suitable for making the body of FIGS. 1*b* and 1*c;*

FIG. 2 is a split drawing in which the upper half shows a tubular body 14 after formation of the shoulder 17 and a short cylindrical neck 19 which is subsequently curled to define the mouth of the can.

The lower half of FIG. 2 shows the tubular body 14 in the start position before forming of the shoulder 17 and neck 19. FIG. 2 shows that the apparatus comprises an external die 20 which defines a convergent work surface 21 therein of like shape to the exterior of the reduced cross-section to be produced; a plug 22 having a work surface 23 thereon of like shape to the interior of the reduced cross-section to be produced; means (best seen in FIG. 6) to hold the plug in axial alignment with the die during relative motion as between the plug and die to centre the plug 22 within the die 20 to define a pass gap of shape and gap width substantially equal to that shape and thickness of the reduced cross-section; crosshead means 24 to push the terminal portion of the tubular body 14 into the pass gap between the plug 22 and die 20, and a transducer 25 connecting with an horn 26 to cause the die 20 to vibrate in a radial mode at an ultrasonic frequency while the terminal portion is progressively reduced to the shape of the pass gap.

In the lower half of FIG. 2 the crosshead 24 is shown in a retracted position in readiness to push the cylindrical tube 14 into the pass gap between the plug 22 and die 20.

In the upper half of FIG. 2 the crosshead 24 is depicted during advance towards the die 20 so that the terminal end of the cylindrical tube is pushed between the profiled work surface of plug 22 and die 20. The dilemma is to avoid excessive frictional resistance to forming by some divergence but also maintain a hoop of constraint on the wall metal between the plug 22 and die 20 at all times to prevent wrinkling.

The risk of frictional forces becoming excessive is overcome by vibrating the die 20 in a radial mode and referring to FIG. 2 it will be seen that a piezoelectric transducer 25 is coupled via a horn 26 which acts as a velocity transformer to a peripheral surface of a die holder 27. Dashed lines W show the wave form of vibration from the transducer to the die and it will be noted that there is a node N at the centre of the die 20.

The distribution of amplitude across the die is such that a fair proportion of the amplitude of the wave/vibration W is active at the profiled work surface 21 of the die 20 which is held in position by the die holder. Whilst one could use higher harmonics or one and a half wavelengths across the die holder the half wavelength efficiently provides the preferred use of the energy.

In order that the ultrasonic vibration is not damped by the mounting used to fix the die holder 27, a tubular mounting 28 is provided. One end of the mounting fits into a recess in the die holder 27 and the other end is free. Notice that the dashed lines show that the mounting may vibrate in a half wavelength denoted (a) or alternatively in a preferred three quarter wavelength mode denoted (b), in which an antinode is energised at the die holder 27 and a first node at a fixing point, and a second node between the die and mounting. This is achieved by clamping of a flange 29 of the tubular mounting 28 at the mid-point along the length of the tubular mounting, and engagement of the die by one end of the mounting.

The flange 29 is held in a recess in the frame portion 30 by a clamping ring 31 which is bolted to the frame portion.

Whilst clamping at a mid-point as shown in FIG. 2 makes it easy to understand what we mean by a resonant mounting clamped at a node it is not, in fact, essential to provide the right hand half of the resonant mounting shown in FIG. 2.

However, it is of course desirable that the mounting be firmly clamped at a node otherwise the fixing, which receives thrust from the work being done, will be under forces that may loosen it and so spoil definition of the pass gap.

When the shoulder and neck have been completely formed by the apparatus of FIG. 2 the plug 22 is fully retracted (to the left in FIG. 2) to permit removal of the cylindrical body 14*a* having a shoulder and neck of reduced diameter at one end.

The benefit of the apparatus of FIG. 2 is that it is able to reduce a 45 mm diameter cylindrical body to a 31 mm neck in a single operation. This is roughly a 30% reduction which by conventional die necking would have required at least two dies.

Figure 3:
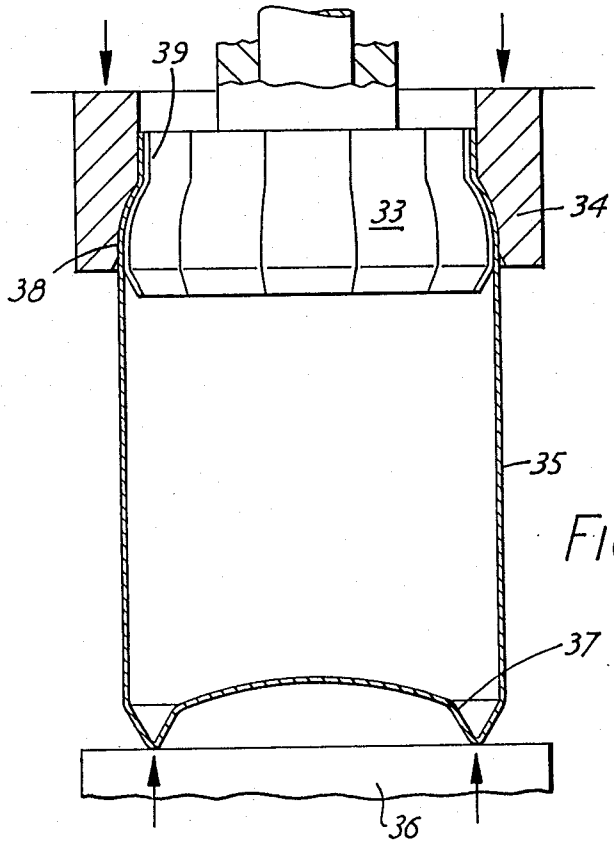
FIG. 3 is a sectioned side view of a drawn and wall ironed beverage can body during formation of a shoulder and neck by a die and a collapsible mandrel.

FIG. 3 shows how the apparatus of FIG. 2 may be adapted to form a shoulder and neck on a beverage can. These cans are commonly 68 mm diameter (2.69 inch) and reduced at the neck to 60 mm (2.38 inch) so that a relatively small aluminium tear open can end may be fitted to them.

In FIG. 3 a collapsible mandrel 33 is depicted in the expanded condition in which it defines, with the interior surface of the die 34 a pass gap into which a terminal margin of a sidewall 35 drawn and wall ironed can be made from aluminium or tinplate, has been pushed by a pusher plate 36 acting on the integral bottom wall 37 of the can. On completion of the shoulder 38 and neck 39 the mandrel 37 is collapsed and the pusher plate 36 retracted to permit removal of the necked can. The neck 39 will then be flanged in a separate operation in readiness to receive a can end fixable by double seaming.

It will be understood that as the diameter of the cylindrical tube 14 is progressively reduced to the form of shoulder 17 and neck 19 depicted the metal will want to thicken. If a pass gap of constant width is used, the metal will try to elongate but be resisted by the frictional forces of the interfaces between the external surface of the cylindrical tube and die profile 21, and internal surface of the tube and plug profile 23. We have discovered that it is advantageous to profile the plug and die to define a pass gap that starts with a width substantially equal to the wall thickness of tube fed to it and increases in width (typically by about 15% of original wall thickness) to permit some thickening. The gap is chosen as a compromise,—largest where pleating not a danger and reducing to material thickness where pleating occurs; increasing to allow material thickening. Also plunger setting varies the gap when material pushes plunger back.

Figure 4:
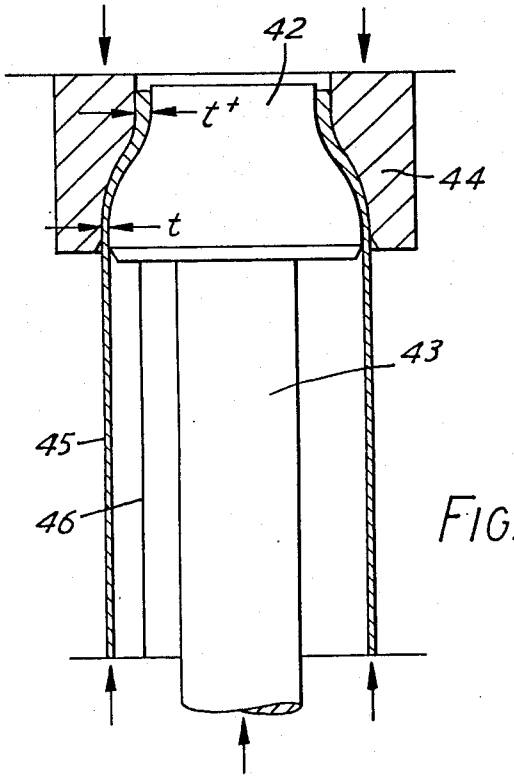
FIG. 4 is a sectioned side view of a welded tubular body during formation of a shoulder and neck by a die and retractable mandrel.

FIG. 4 shows a modified form of the plug and die of FIG. 2. In FIG. 4 the plug 42 is supported on a long rod or plunger 43. Notice that the pass gap, defined by the interior surface of the die 44 and exterior surface of the plug 42, initially has a width equal to thickness t of the welded metal cylinder and widens at the neck to accommodate thickening t+. This increase in pass gap width is particularly desirable when forming a shoulder and neck of reduced diameter on a cylinder 45 having a welded side seam 46. Typically the weld 46 is formed as a forged lap weld (e.g. the "WIMA") [trademark] weld made on apparatus sold by Soudronic A.G.). However, the butt welds made by laser welding may also benefit from this apparatus.

FIG. 5 shows diagrammatically the steps (1–6) from cylinder to necked cylinder and assists understanding of the more complicated FIGS. 6(*a*) and 6(*b*) which show the tools actually used to reduce a 45 mm diameter welded cylinder of decorated tinplate (e.g. white external coating) to an aerosol can body having a shoulder and neck 25.4 mm diameter to receive a standard 25.4 mm (1 inch) diameter valve cup.

In FIG. 5(1) a plug 42 is shown in the retracted position with its work profiles in the crosshead 24 at a distance of about the length of a can body from the mouth of the die 20. Notice the ejector 46 to the right of the die. A cylindrical body 45 has been located between the crosshead and die.

In FIG. 5(2) the plunger/plug has been advanced through the cylindrical body so that the profiles of the plug and die define the pass gap. The end face of the plug 42 abutts the end face of the ejector 46.

In FIG. 5(3) the crosshead 24 advances to push one end of the cylindrical body into the pass gap defined by punch and die while the die 20 is vibrated at an ultrasonic frequency in the range 15 K HZ to 40 K HZ in a radial mode.

In FIG. 5(4) the crosshead 24 and plunger/plug 42 have been retracted leaving the newly formed shoulder and neck in the die.

In FIG. 5(5) the ejector 46 has pushed the newly formed neck out of die to permit removal of the cylinder 47, having a shoulder 17 and neck 19, from the apparatus.

FIG. 6(*a*) corresponds to FIG. 5(5) and it will be seen that a necked cylindrical body 47 is about to be removed from an arcuate member 48 supported on a rod 49 rooted in the crosshead 24. After removal of the necked body, the apparatus is ready to receive a tubular body for necking.

In FIG. 6(*a*) the apparatus can be seen to comprise a die 20 mounted in a die holder 27 which is operably connected for vibration at ultrasonic frequency, to a horn 26; a crosshead 24, with arcuate support 48, movable towards and away from the die 20; a plunger 43 which terminates in a profiled plug 42 movable into and out of the die by means of an hydraulic cylinder (not shown); and an ejector pad 46 which, when in use, abutts the end face of the plug 42 and is movable within the die 20 by means of air pressure to eject a necked can body and is retracted by spring pressure.

The plunger, crosshead die and ejector are held in axial alignment by columns, one of which is denoted "50", and cross plates one of which is denoted "51", shown in FIG. 6(*b*).

Referring to FIG. 6(*b*) it will be seen that the plunger 43 has been moved to hold the plug 42 in the die 20 to define the pass gap. The crosshead 24 has been advanced to push the leading edge of a cylindrical can body into the pass gap as energy from the horn 26 excites the die to vibrate in a radial mode at an ultrasonic frequency in the range 15 K HZ to 40 K HZ. We prefer to use a frequency between 20 and 22 K HZ to obtain maximum amplitude of vibration at the working surface of the die 20 for any chosen power setting and avoid excessive audible noise.

Higher frequencies of vibration, e.g. 40 K HZ permit use of a smaller die but at increased risk of straying into undesirable modes of vibration as will be discussed by reference to FIG. 8. The larger the die the higher is the energy needed to vibrate it (all other factors being equal). In the apparatus of FIG. 6*b* a welded tube of tinplate 45 mm diameter has been moved into the pass gap defined by plug and die to create a shoulder supporting a cylindrical neck 31 mm diameter (a 30% reduction on diameter). The plunger/plug 43/42 is about to be retracted after which the ejector 46 will be lifted by air pressure under a piston portion 52 of the ejector so that the piston moves in the ejector housing 53 to eject the shaped can body and compress an ejector return spring 54. Once the can is ejected, the air pressure is abated and the return spring 54 urges the ejector 46 to retract to the position shown in FIG. 6(*a*). The travel of the ejector is limited by the piston stroke. A screw 55 protrudes through the side wall of the ejector housing into a slot 56 in the side wall of the ejector to act as a retainer as shown in FIG. 6(*a*) only.

Figure 6A:
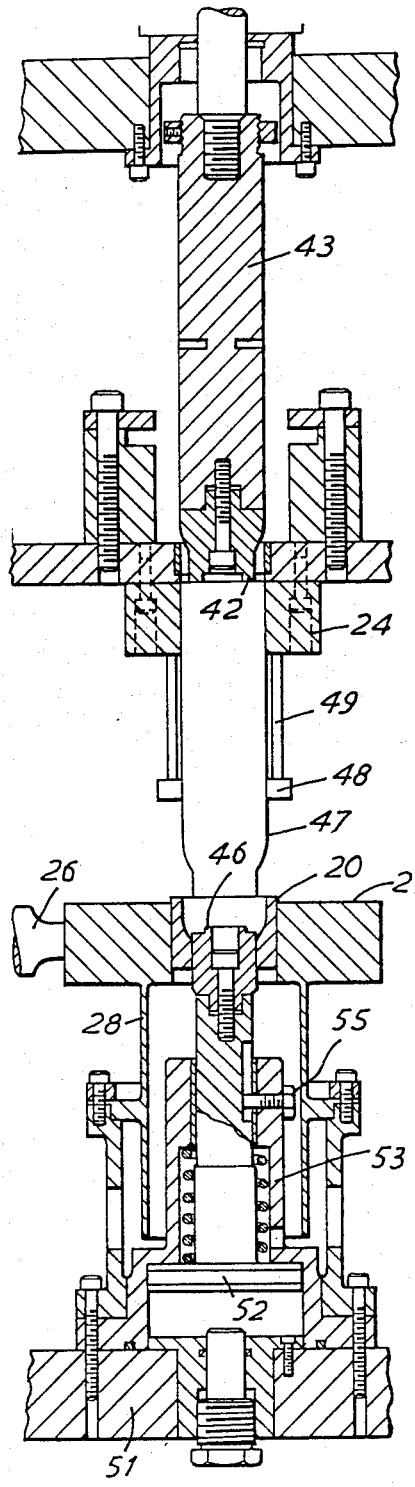
FIG. 6*a* is a detailed sectioned side view of apparatus carrying out the steps of FIG. 5 in an open position.
Figure 6B:
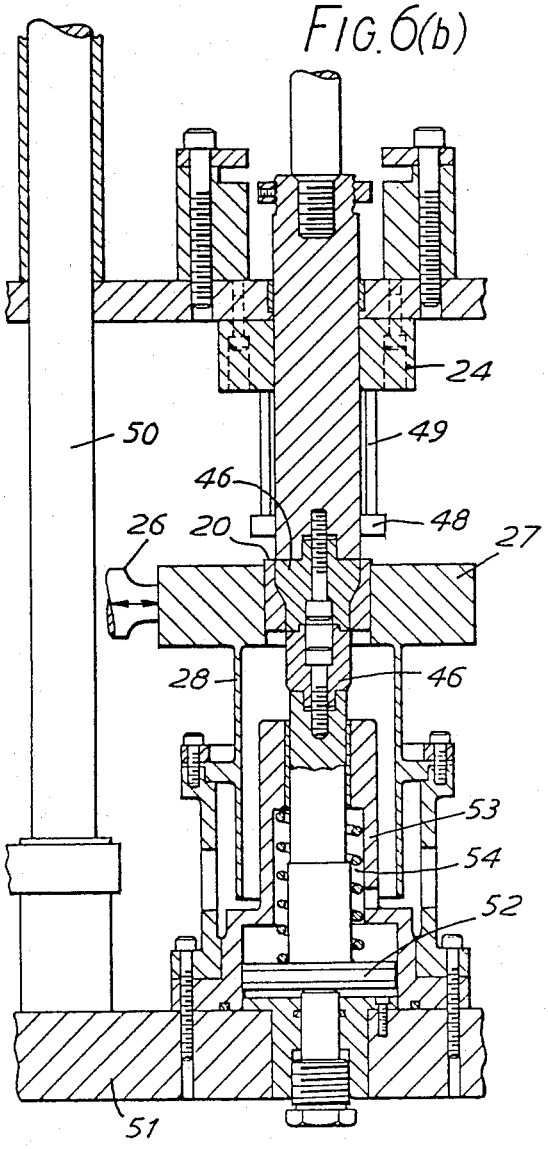
FIG. 6*b* is a like view of the apparatus of FIG. 6(*a*) in a closed position.

The can 47 produced by the apparatus of FIGS. 6*a*, 6*b* is then passed to a known die curling apparatus to deform the extremity of the neck inwardly to the form of an inwardly directed curl 18 defining the mouth (25.4 mm diameter) of an aerosol can as shown in FIG. 1*c*. The can is completed by attachment of a bottom wall. The bottom wall may be attached by means of a conventional double seam or alternatively may be necked in as depicted in FIG. 1*c* so that the inwardly folded seam is not obtrusive when the can stands on a surface.

If reductions in diameter beyond 30% are required, the neck material produced in a first ultrasonically assisted necking operation may be further reduced in a second ultrasonically assisted necking operation. We have found it necessary to support the shoulder material, formed by a first necking operation, during any subsequent operation and this support is achieved by means of a profiled sleeve which surrounds the second operation plug as will be described with reference to FIGS. 7*a* to 7*f*.

Referring to the sequence of operations shown in FIG. 7*a* it will be seen that:

1. A necked cylinder 47 is fed into the space between a crosshead 60 and a second operation die 61;
2. A second operation plunger 62 and surrounding support sleeve 63 advance to enter the necked cylinder 47 and the support sleeve 63 engages the shoulder 17 of the necked cylinder and a plug portion 64 of the end of the plunger passes through the neck 19 to be located centrally in the die 61 to define a pass gap and abut an ejector 65.
3. The crosshead 60 and internal support sleeve 63 then advance together to drive the necked portion of the cylinder 47 into the pass gap to form a second operation neck 66 of reduced diameter, supported on a second shoulder portion 67 which blends into the shoulder formed by the first necking operation. FIG. 7*d* shows an intermediate position of the support, plug and die during the progress.
4. The crosshead, plunger/plug, and support sleeve are then retracted leaving the newly formed neck 66 and shoulder 67 in the die 61.
5. The ejector 65 then advances to knock out the twice necked cylinder 68 into the space between the die and crosshead in readiness for removal.
6. The ejector is then retracted from the die and the process is ready to start again.

Figure 7B:
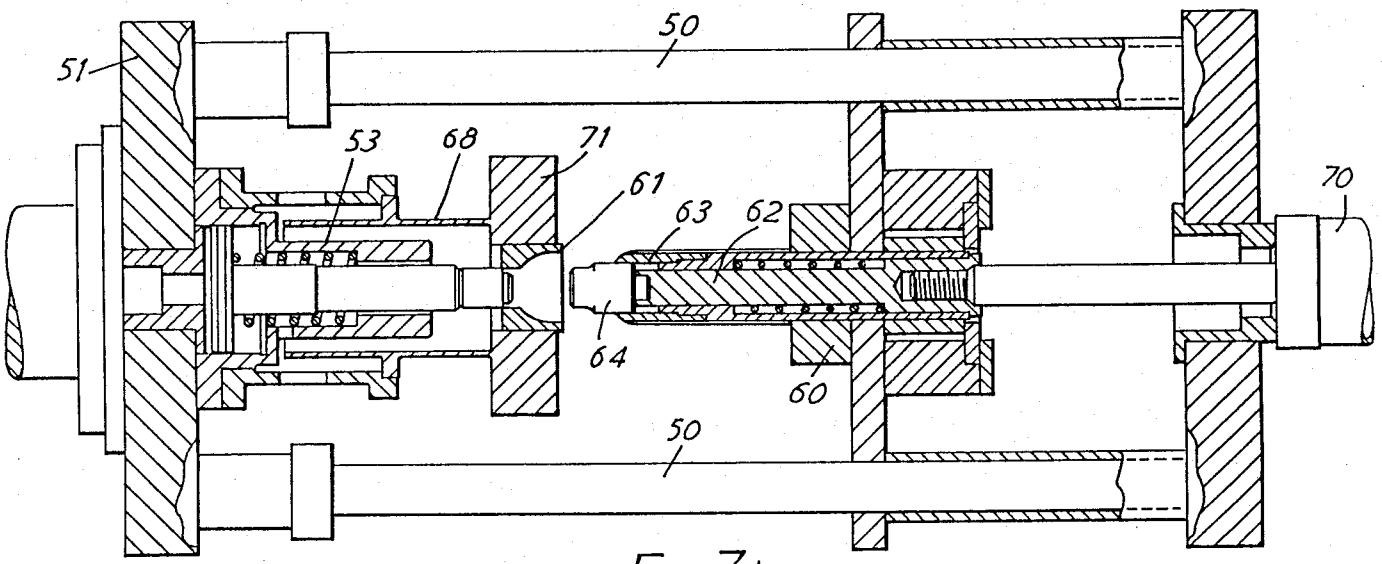
FIG. 7*b* is a side view of apparatus for carrying out the steps of FIG. 7*a;*
Figure 7D:
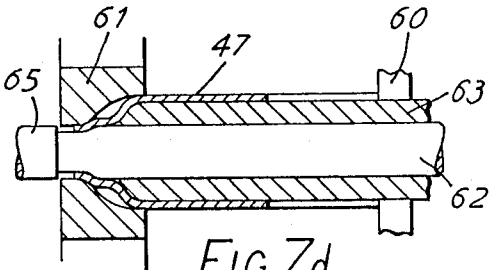
FIG. 7*d* is a detailed view of plug and die during second necking operation.
Figure 7C:
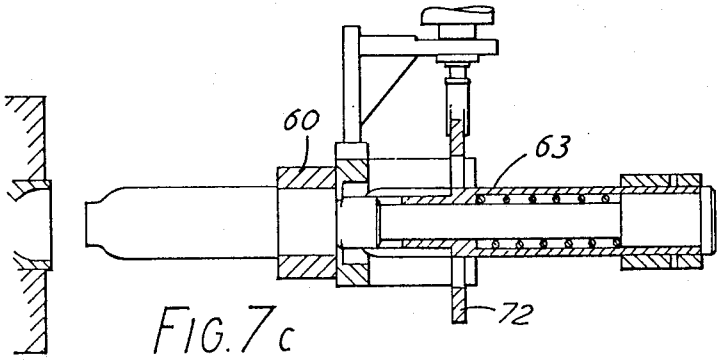
FIG. 7*c* is a side view of the apparatus of FIG. 7*b* after use.

The steps 1 to 6 are carried out in the apparatus shown in FIGS. 7*b*, 7*c*. In FIG. 7*b* the apparatus is similar to the apparatus of FIGS. 6*a* and 6*b* in that it has a first end plate and a second end plate held apart by pillars 50. The first end plate 51 supports the ejector housing 53, a die support 68 and a die 61 in a die holder 71. The second end plate 69 supports an air cylinder 70 which moves the plunger 62 towards and away from the die 61. The pillars 50 support a crosshead 72. In FIG. 7*b* the plunger 62 terminates at a plug 64 having an external profile to define with the die a second operation pass gap to define the shape of reduced shoulder and neck end to be produced. The plunger 62 is surrounded by a support sleeve 63 having one end adapted to fit against the interior surface of the shoulder of a cylinder 47 necked by the first operation.

The support sleeve 63 is a sliding fit upon the plunger 62 so that it may be retracted through the crosshead 72 with the plunger as shown in FIG. 7*a*–*f* to permit feeding in of a cylinder 47, and advanced through the crosshead for locking to the crosshead at the position shown in FIG. 7*b* for subsequent transport with the crosshead to drive a cylinder thereon onto the die.

FIG. 7*d* shows that as the neck of the preformed cylinder 47 enters the pass gap the internal support sleeve 63 is supporting the preformed shoulder to prevent collapse as the crosshead 60 thrusts the cylinder progressively into the die.

FIG. 7*c* shows diagrammatically how the support sleeve 63 may be latched to the crosshead 60 by a plate 72 having a keyhole shaped aperture. The plate is driven into latching position by an air cylinder mounted to one side of the crosshead. Other latching means such as a solenoid system may be used if desired.

Figure 7E:
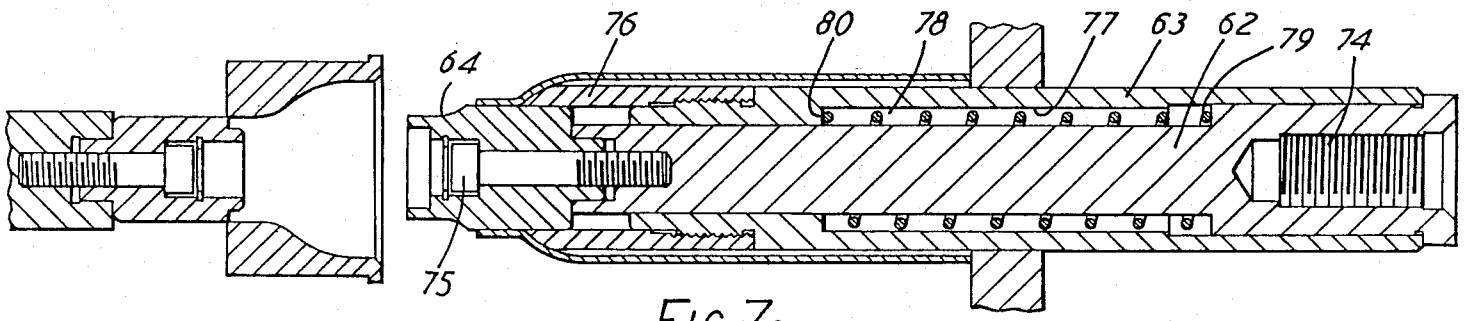
FIG. 7*e* is a sectioned side view of the plug and die of FIG. 7*b* open.
Figure 7F:
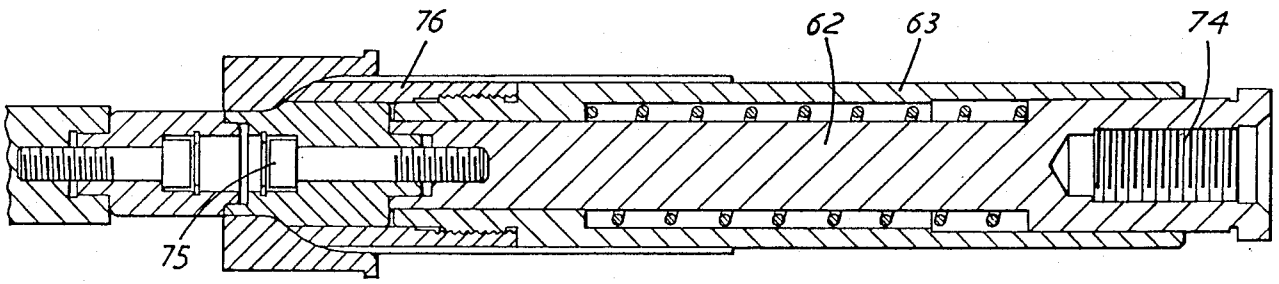
FIG. 7*f* is a like view of the plug and die details during the second operation.

FIG. 7*e* shows in detail the structure of one form of the support sleeve 63 and plunger 62. The plunger 62 has a threaded recess 74 at one end to receive a connecting rod reaching to the actuating air cylinder 70. At the other end the plug 64 is attached to the plunger by a cap head screw. The support sleeve 63 comprises a profiled shoulder portion 76 which is screwed onto the plunger portion so that it can be replaced when worn. The support sleeve 63 defines a longitudinal bore 77 which houses a spring 78 which is compressed between a ledge 79 of the plunger portion and a ledge 80 on the sleeve.

The plug 64 is connected to an air cylinder directly. Sleeve 3 is connected through a spring which normally holds sleeve "up", but allows overtravel of plug. When a can first enters the die, the plug must be in place but the sleeve is held "down" (locked to crosshead) so compressing the spring.

FIG. 8 shows a few of the possible modes of vibration that an annular die may adopt when excited by a transducer. FIG. 8*a* shows the preferred fundamental radial mode of vibration we prefer to use because the vibration is evenly distributed around the die so that any stiction effects and frictional forces in the die are evenly abated.

Figure 8A:
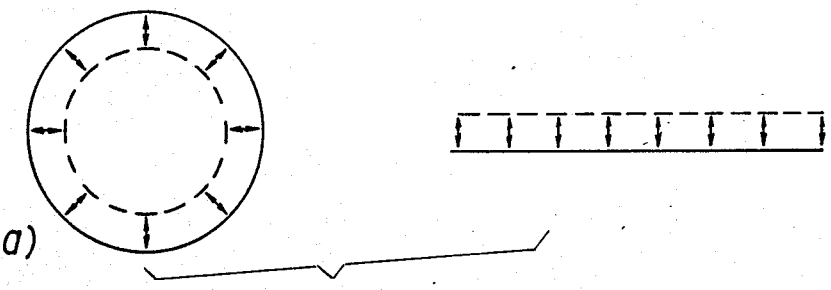
FIG. 8 is a diagrammatic representation of the modes of radial vibration that may be applied to the die.
Figure 8B:
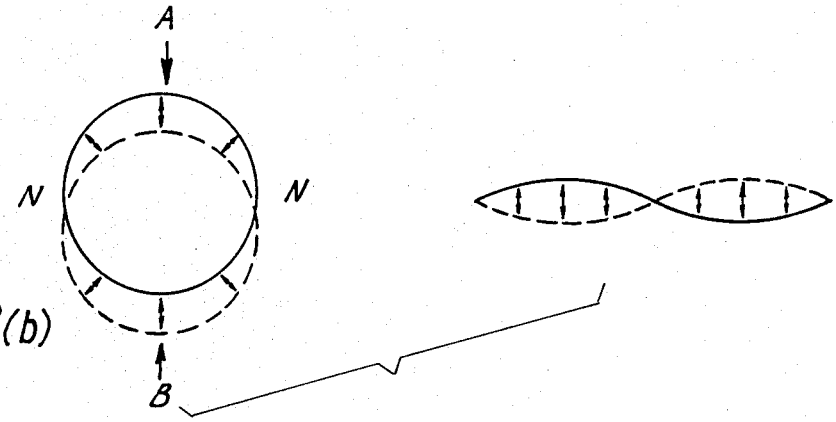

FIG. 8*b* shows a first harmonic mode which is undesirable because nodes N of radial motion arise at diametrically opposed positions to provide no beneficial reduction in friction in the die at these points. This mode may be suppressed by applying a transducer at both diametrically opposed positions A and B at 90° to the diameter on which the nodes develop.

Figure 8C:
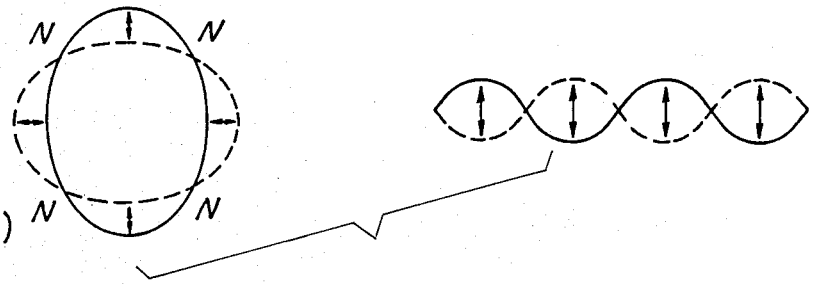

FIG. 8*c* shows a second harmonic in which four nodes develop which are not helpful and difficult to abate. First and third harmonics are problems because their frequencies tend to be close to fundamental.

Figure 8D:
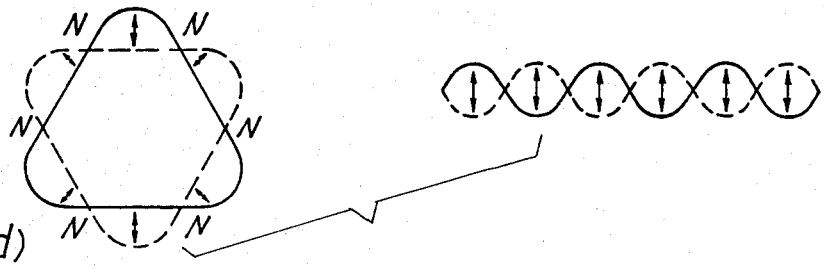

FIG. 8*d* shows a third harmonic node in which six nodes develop.

In order to maintain the vibration in the fundamental mode our dies are dimensioned so that the fundamental mode is not close to any of the harmonics.

Figure 9:
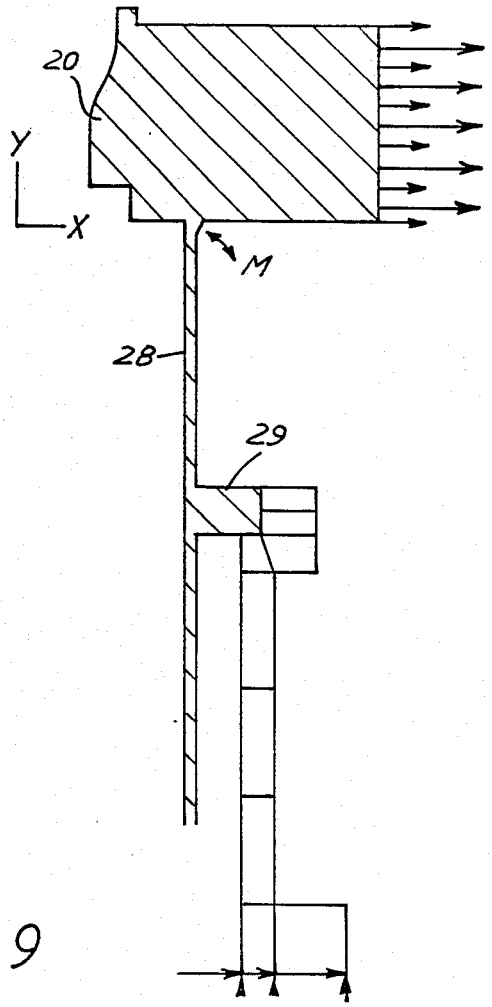
FIG. 9 depicts finite element analysis of the ultrasonically vibrated die.

FIG. 9 shows a finite element analysis of our first operation die.

The assembly is modelled in 2-dimensions using axisymmetric elements, i.e. the plot shows the cross-hatched areas in a cross-section of the assembly. The centreline is along the Y axis.

The die 20 is forced into motion by radial forces on its outside surface (horizontal arrows). A thin tubular mounting 28 is fixed to lower surface of the die and held on a flange 29 as already described with reference to FIG. 2. The flange provides a link between the vibrating die 20 and the stationary machine.

The mounting is resonant at 20 K Hz and is, therefore, very compliant at this frequency, although it is effectively rigid at low frequency. The radial mode of vibration of the die induces radial and some longitudinal vibration in the tubular support so that at the junction of die and support a resolved direction of vibration obtains.

The tubular supports of FIGS. 2, 6 and 7 serve to maintain the die concentric with the plug; support the thrust of the work load; and minimise the loss of radial vibration at the mounting of die to support at the position arrowed M in FIG. 8.

Figure 10:
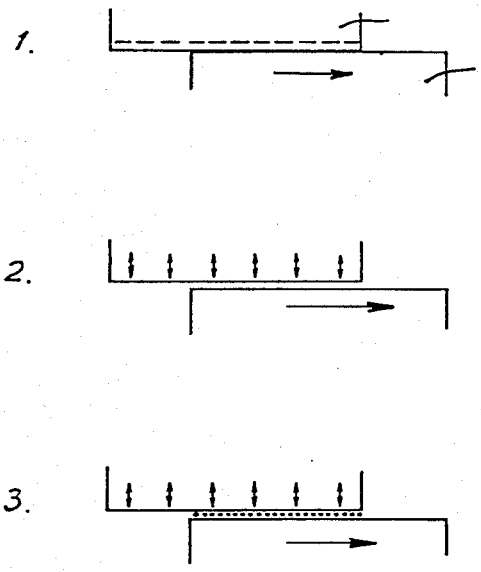
FIG. 10 shows diagrammatically the mechanisms of friction reduction by ultrasonic vibration of die.

FIG. 10 explains why we prefer to vibrate our die in a radial direction and is self explanatory.

In FIG. 10(1) periodic reversal of the friction sector between a die D and a workpiece W is depicted as arises when the die is vibrated in an axial direction parallel to the surface of the workpiece. If the maximum velocity of vibration is greater than the velocity of workpiece motion then the relative velocity (and the friction) will reverse for part of the vibration cycle.

FIG. 10(2) shows how periodic separation of surfaces can be achieved by vibration normal to the interface between die and workpiece. For part of the cycle the surfaces may separate so reducing friction to zero.

FIG. 10(3) shows diagrammatically how "pumping" of a lubricant can be achieved by vibration of the die in a direction normal to the surface of the workpiece. The vibrations help to distribute the lubricant evenly over the surface and prevent breakdown of the lubricant film at points of high stress.

The periodic separation of FIG. 10(2) and more particularly the pumping action of FIG. 10(3) are thought to be most useful in our efforts to reduce the diameter of tubular components of thin wall thickness. Hence we choose a fundamental radial mode for maximum geometrically normal vibration.

Figure 11:
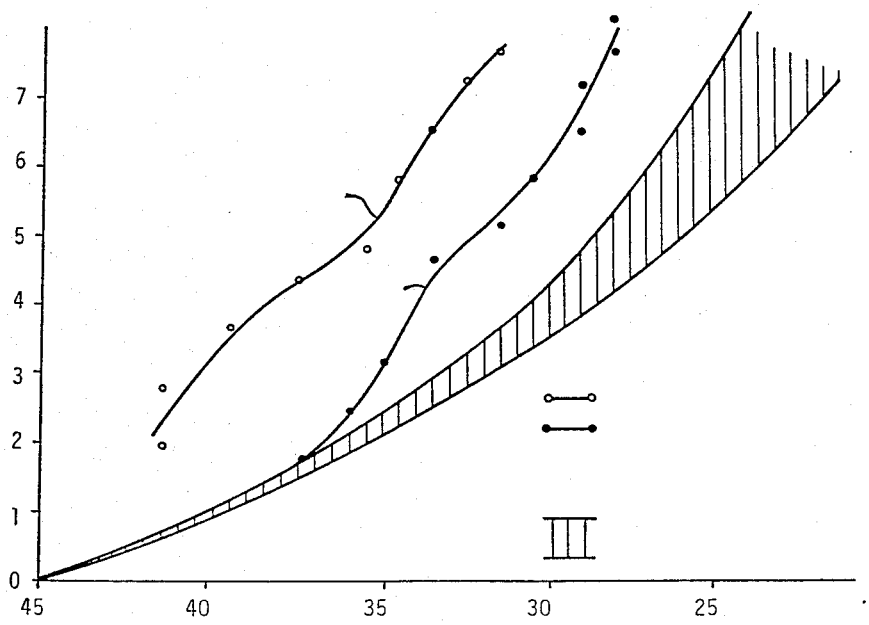
FIG. 11 is comparative graphs of force to drive the 45 mm diameter can body into the pass gap v final reduced neck diameter.

FIG. 11 shows graphs of the force in KN required for reducing a 45 mm cylinder to the neck sizes plotted. Graph (a) shows the force required without ultrasonic vibration and graph (b) shows the force required when ultrasonic vibration at 20 kHz is applied in a radial direction by a magnetostrictive transducer of 1.5 KW power. However, similar benefits are achieved using piezoelectric transducers at like frequency, and lower power.

It will be noted in the analysis of FIG. 9 that die and support are treated as a single structure as shown in FIGS. 6 and 7. They may be, in reality, a single structure.

Figure 12:
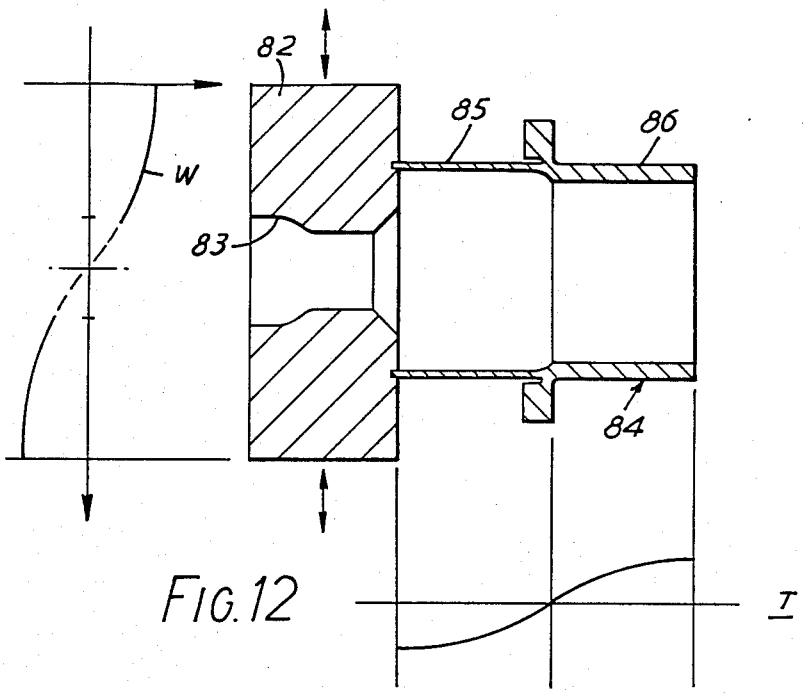
FIG. 12 is a sectional side view of tuned ring support for a die vibrated radially.

FIG. 12 shows a die 82 vibrated with a node in the centre and antinodes at its periphery so that a substantial proportion of amplitude is active at the working surface 83 defining a pass gap as will be seen from the half wavelength W depicted alongside the die. A tubular support 84 abutts the die, and comprises a first thin walled portion 85 abutting a second thicker walled tubular portion 86 extending in axial alignment from the thin walled tubular portion, and a mounting flange surrounding the junction between thin and thick walled tubular portion. The thin walled tubular portion is tuned for radial vibration so that the vibration received induces a longitudinal vibration in the thin walled portion in which the amplitude is attenuated so that the support has an antinode at the die and a node at the mounting flange.

Figure 13:
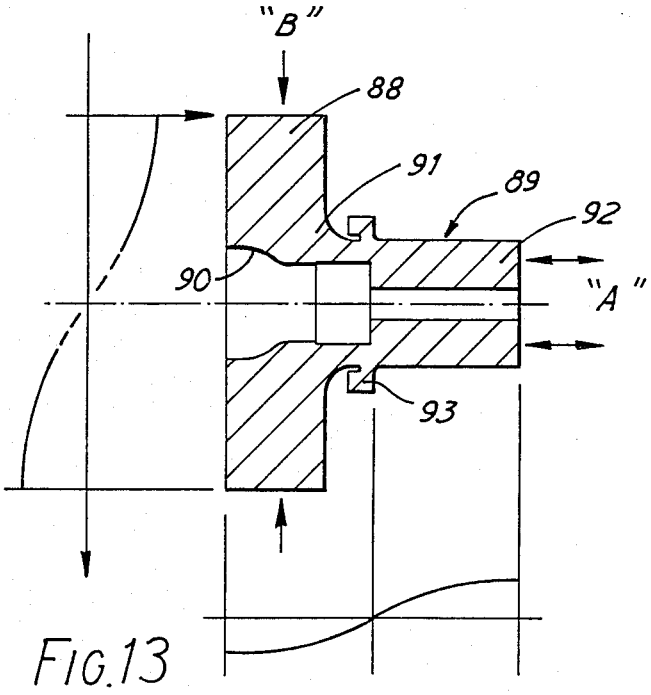
FIG. 13 is a sectioned side view of a ring support for a die vibrated both axially and radially.

FIG. 13 shows a die 88 integral with a hollow support 89. The die 88 has an internal work surface 90 shaped to define the exterior of a cylindrical workpiece to a shoulder and neck when the die cooperates with a plug having a complementary profile.

The support comprises a first portion 91 connecting with die and extending axially as its annular cross-section reduces to a second portion 92 having a cylindrical form which is axially aligned with the die and has a bore less than that of the first portion. Where first and second portions meet an annular flange 93 surrounds the support to permit fixing to a machine. In the past this form of integral die with support has been used, in cooperation with a cylindrical punch, to draw a cup from a flat blank while axially induced vibration denoted "A" was applied through the second portion.

We have discovered that, this integral die and support may be used to neck a cylinder when provided with a suitable work surface as shown, and cooperating with a complimentary plug as already described, provided the die is vibrated radially denoted B not axially.

Figure 14:
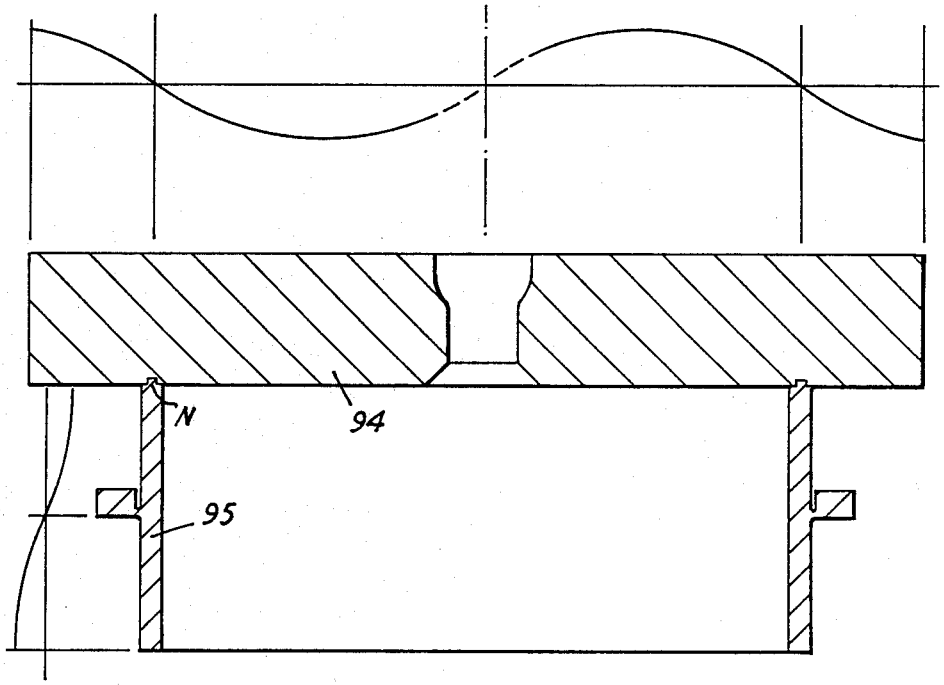
FIG. 14 is a sectioned side view of large area die and support.

FIG. 14 shows a die 94 having a large diameter such as may be necessary for reducing the diameter of the mouth of a beverage can from 68 mm (2.69 inch) diameter to 57 mm (2.25 inch) or 60 mm (2.38 inch) dia. The die is supported by a tubular support 95 which is clamped at a node as already described. However, the support joins the die at a node N, as will be seen from the waveform above the die, so that the energy induced in the support by the die is very little.

This is achieved by vibrating the die with a node at the centre but making it big enough to contain a node within its periphery as will be clear from the waveform depicted above the die. This die may be tuned to the first harmonic resonance in a radial mode as shown in FIG. 14. The fundamental may be audible to unsociable levels of noise.

Figure 15:
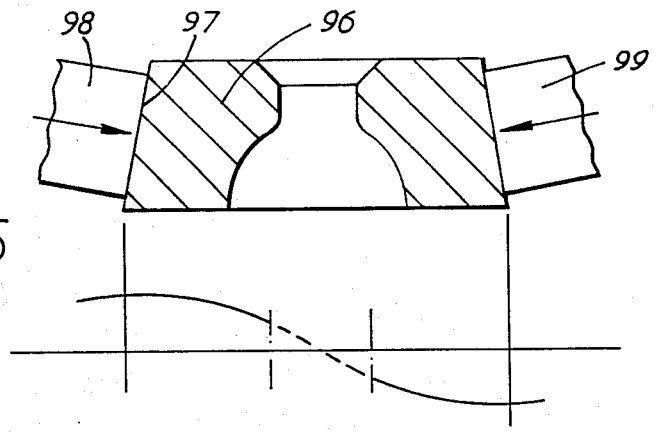
FIG. 15 is a sectioned side view of a die having a frustoconical wall angled for coupling to a transducer.

FIG. 15 shows a die 96 having a frustoconical outer surface 97 onto which the ultrasonic vibration 15 may be applied by a transducer 98. As already described, the die is vibrated to have a node at the centre so that a proportion of the amplitude is available at the interior working surface but due to the inclination of the direction of application of vibration, this die will deliver both a radial vibration and, to a lesser degree, some axial vibration. A second transducer 99, may, if desired, be applied to this die to alternate any stray modes of vibration such as harmonics or twisting.

Figure 16:
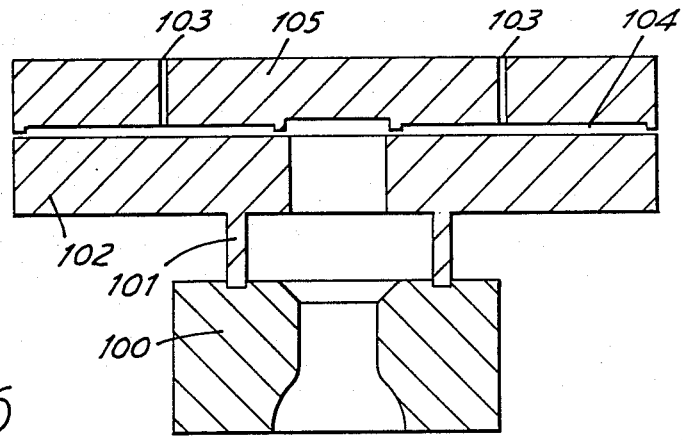
FIG. 16 is a sectioned side view of a large area fluid bearing for a die support and die.

FIG. 16 shows an alternative means to support the die support and die without recourse to clamping on a flange as already described. In FIG. 16 the die 100 is supported by a tubular support 101 which has a base plate 102 of area substantially larger than the diameter of the tubular support. The base plate 102 rides on fluid delivered through a plurality of passages 103 into an annular recess 104 in a bearing plate 105 to spread between the base plate and bearing plate.

Figure 17:
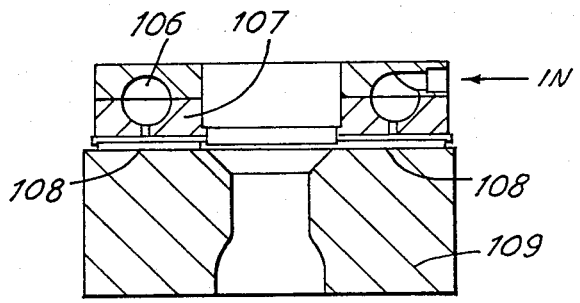
FIG. 17 is a sectioned side view of an annular fluid bearing supporting a die.

The apparatus of FIG. 17 works in a similar manner to that of FIG. 16 but has an annular distribution passage 106 in the annular bearing plate 107 from which pressurised fluid emerges through a plurality of passages 108 to support the die 109. The periphery of die and bearing plate is sealed by a flexible seal 110. This means to support the die relies on the fluid support permitting vibration of the die without consuming the energy of vibration.

Figure 18A:
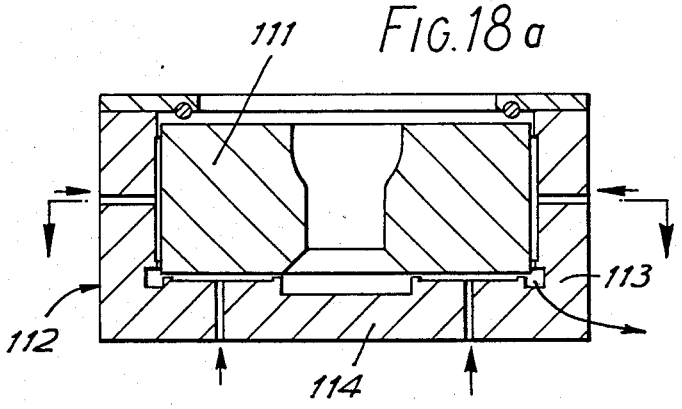
FIG. 18*a* is a sectioned side elevation.
Figure 18B:
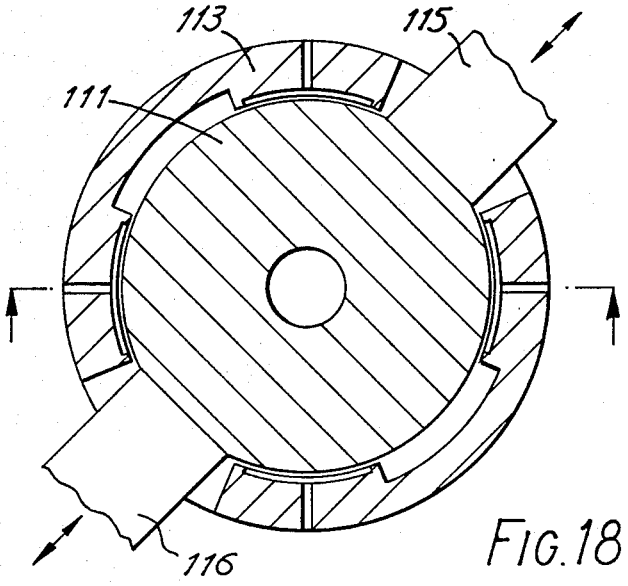
FIG. 18*b* is a plan view of a die and support aerostatic support.

FIGS. 18*a* and 18*b* depict a die 111 supported aerostatically in a housing 112 having a tubular side wall 113 and a basal wall 114. The side wall 113 defines with the cylindrical wall of the die 111 an annular cavity into which compressed air is introduced to provide a radial support.

The base of the die 111 and recesses in the basal wall 114 define a cavity into which compressed air is introduced to support the die against the working load.

Referring to FIG. 14*b*, it will be seen that the side wall 113 of the housing is cut away to provide access for a transducer horn 115 to reach into operable engagement with the die. If desired a second transducer 116 may also be used.

Whilst the invention has been described with reference to an aerosol can and a beverage can, it may be applied to any tubular articles made of ductile metal such as irrigation pipes and rainwater goods which have a similar need for reduction of the diameter of one end.

Figures 19A, 19B:
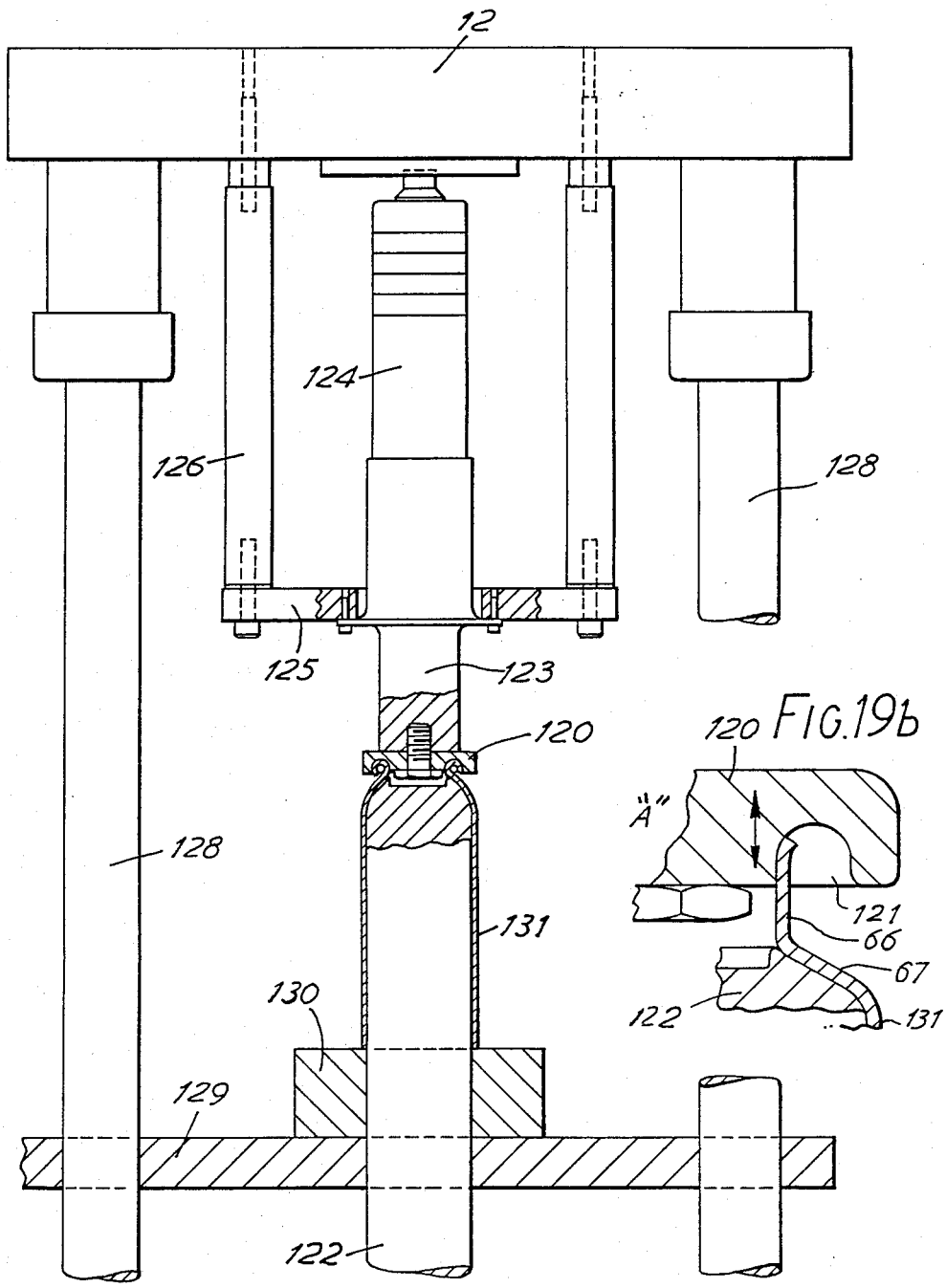
FIG. 19 is a sectioned side view of ultrasonically assisted curling apparatus.

In FIGS. 19*a* and 19*b* apparatus, for deforming a cylindrical neck 66 to an outwardly directed curl, comprises a die 120 having an annular groove 121 which defines the exterior surface of the curl; mandrel means 122 to support and drive the cylindrical neck into the annular groove; and means to vibrate the die in a direction parallel to the axis of the neck as indicated by arrow "A" in FIG. 19*b*. The curl of arcuate cross-section is progressively developed as the neck is driven into the groove as can be seen in FIG. 19*b*.

Referring to FIG. 19*a* the die is supported on a horn 123 which is axially aligned and operably connected to a transducer 124 which is preferably piezoelectric and capable of generating a first harmonic mode having a frequency between 18 and 25 K Hz; a preferred value being 20 K Hz to 22 K Hz. The horn 123 and horn support plate 125 are suspended by rods 126 from a plate 127 which is in turn supported by pillars 128 which pass through and support a crosshead 129 slidable upon them.

The crosshead 129 supports a pusher plate 130 and a mandrel 122 which is movable through the crosshead 129 and pusher plate 130 to axially align a can body 131 with the axis of the die 120 and pusher plate 130. During a curling operation, a shoulder portion 67 of the can 131 is supported on a shoulder portion of the mandrel 122 and advanced so that the neck portion 66 is pushed into the annular groove 121 of the die 120 as shown on an enlarged scale in FIG. 19*b*. The die is vibrated in an axial direction at a frequency of 20 to 22 K Hz. Continued advance of the pusher plate 130 and mandrel 122 causes the neck to be completely curled to the form of an outwardly directed curl shown in FIG. 19*a*.

It is believed that the application of ultrasonic vibration to the curling die reduces frictional forces so that a die profiled to receive the neck made by the apparatus of FIG. 6 may be used to create the inwardly directed curl of FIG. 1*c* if desired.

We claim:

1. A method of reducing the cross-section of a terminal portion of a tubular body, said method comprising the steps of providing an external die which defines a convergent work surface therein of like shape to the exterior of the reduced cross-section to be produced; providing a plug having a work surface thereon of like shape to the interior of the reduced cross-section to be produced; locating the plug within the die to define therebetween a pass gap having the shape of the reduced cross-section to be produced and a radial width substantially equal to the thickness of the tubular body; entering the terminal portion of the tubular body into the pass gap; and simultaneously causing the die to vibrate in a radial mode at an ultrasonic frequency while the terminal portion is progressively deformed to the shape of the pass gap.

2. A method according to claim 1 wherein the tubular body is a can body having a bottom wall and a side wall drawn or extruded from a metal blank.

3. A method according to claim 1 wherein the tubular body is a cylinder made by welding opposed edges of a rectangular blank of sheet metal.

4. A method according to claim 1 wherein the die is held in axial alignment with the plug by means of a support which is itself held at a node to resist the working thrust of the body entering the pass gap.

5. A method according to claim 1 wherein the support is tubular and held mid-way along its length.

6. A method according to claim 1 wherein the frequency of vibration at the die is within a range of 15 kHz to 40 kHz.

7. A method according to claim 6, wherein the frequency of vibration is at the range 20 to 30 kHz.

8. A method of making a can body wherein a necked component is made by the method of claim 1 and is subsequently supported on a mandrel and driven towards a curling die having an annular curling groove so that a neck portion of the component is progressively curled while ultrasonic vibration is applied to the die.

9. Apparatus for reducing the cross-section of a terminal portion of a tubular body said apparatus comprising an external die which defines a convergent work surface therein of like shape to the exterior of the reduced cross-section to be produced; a plug having a work surface thereon of like shape to the interior of the reduced cross-section to be produced; means to hold the plug in axial alignment with the die during relative motion as between the plug and die to centre the plug within the die to define a pass gap of shape and gap width substantially equal to that shape and thickness of the reduced cross-section; means to enter the terminal portion of the tubular body into the pass gap between the plug and die and means to cause the die to vibrate in a radial mode at an ultrasonic frequency while the terminal portion is progressively reduced to the shape of the pass gap.

10. Apparatus according to claim 9, wherein the convergent work surface comprises a first annulus of arcuate cross-section leading to an inflection portion which connects with a substantially cylindrical portion.

11. Apparatus according to claim 10, wherein the plug has a work surface of complementary shape to the convergent work surface of the die and, when centred therein, defines with the work surface of the die a pass gap of width progressively increasing along its length to a width greater than the thickness of the tubular body to accommodate thickening at the newly formed neck.

12. Apparatus according to claim 9 wherein the die is held in axial alignment with the plug by a tuned support means which is held at a mode.

13. Apparatus according to claim 12, wherein the support means is tubular and held mid-way along its length.

14. Apparatus according to claim 13, wherein the support means is a plurality of rods each rod being held mid-way along its length.

15. Apparatus according to claim 14, wherein the support means is a fluid such as compressed air or oil contained in a housing.

16. Apparatus as claimed in claim 9 further comprising means for deforming a cylindrical neck of a tubular body to an outwardly directed curl, said deforming means comprising a die having an annular groove therein of arcuate cross-section, a mandrel means to support and drive the cylindrical neck into the annular groove, and means to vibrate the die at an ultrasonic frequency, in a direction parallel to the axis of the neck.

* * * * *